US008479802B1

(12) United States Patent
Tilak et al.

(10) Patent No.: US 8,479,802 B1
(45) Date of Patent: Jul. 9, 2013

(54) APPARATUS FOR CASTING ALUMINUM LITHIUM ALLOYS

(75) Inventors: Ravindra V. Tilak, Orange, CA (US); Rodney W. Wirtz, Lake Forrest, CA (US); Ronald M. Streigle, Anaheim, CA (US)

(73) Assignee: Almex USA, Inc., Bueno Park, CA (US)

( * ) Notice: Subject to any disclaimer, the term of this patent is extended or adjusted under 35 U.S.C. 154(b) by 0 days.

(21) Appl. No.: 13/474,616

(22) Filed: May 17, 2012

(51) Int. Cl.
*B22D 11/049* (2006.01)
*B22D 11/124* (2006.01)

(52) U.S. Cl.
USPC ..... 164/487; 164/486; 164/444

(58) Field of Classification Search
USPC ..... 164/486, 487, 444
See application file for complete search history.

(56) References Cited

U.S. PATENT DOCUMENTS

| | | | |
|---|---|---|---|
| 2,863,558 | A | 12/1958 | Brondyke et al. |
| 3,006,473 | A | 10/1961 | Gamber |
| 3,235,089 | A | 2/1966 | Burroughs |
| 3,281,238 | A | 10/1966 | Bachowski et al. |
| 3,451,465 | A | 6/1969 | Moritz et al. |
| 3,524,548 | A | 8/1970 | McDonald et al. |
| 3,895,937 | A | 7/1975 | Gjosteen et al. |
| 3,947,363 | A | 3/1976 | Pryor et al. |
| 4,113,241 | A | 9/1978 | Dore |
| 4,188,884 | A | 2/1980 | White et al. |
| 4,214,624 | A | 7/1980 | Foye et al. |
| 4,221,589 | A | 9/1980 | Verstraelen |
| 4,237,961 | A | 12/1980 | Zinniger |
| 4,248,630 | A | 2/1981 | Balmuth |
| 4,355,679 | A | 10/1982 | Wilkins |
| 4,395,333 | A | 7/1983 | Groteke |
| 4,427,185 | A | 1/1984 | Meyer |
| 4,444,377 | A | 4/1984 | Groteke |
| 4,501,317 | A | 2/1985 | Sokolowski |
| 4,528,099 | A | 7/1985 | Rieger et al. |
| 4,556,535 | A | 12/1985 | Bowman et al. |
| 4,567,936 | A | 2/1986 | Binczewski |
| 4,581,295 | A | 4/1986 | DeLiso et al. |
| 4,582,118 | A | 4/1986 | Jacoby et al. |
| 4,593,745 | A | 6/1986 | Yu et al. |
| 4,597,432 | A | 7/1986 | Collins et al. |
| 4,598,763 | A | 7/1986 | Wagstaff et al. |
| 4,607,679 | A | 8/1986 | Tsai et al. |

(Continued)

FOREIGN PATENT DOCUMENTS

| | | |
|---|---|---|
| CA | 1309870 | 11/1992 |
| CN | 101648265 | 2/2010 |

(Continued)

OTHER PUBLICATIONS

"Semi-Continuous Casting Plant Produces Aluminium-Lithium Alloys", Met. Ind. News 3, (Sep. 1986), Abstract.

(Continued)

*Primary Examiner* — Kevin P Kerns
*Assistant Examiner* — Kevin E Yoon
(74) *Attorney, Agent, or Firm* — Blakely Sokoloff Taylor & Zafman LLP

(57) ABSTRACT

Direct chill casting that allows for the continuous or serial introduction of an inert fluid into the coolant stream during casting while allowing for stoppage of the coolant flow and introduction of only inert fluid as the coolant in the event of a "bleed out" or "run out".

18 Claims, 3 Drawing Sheets

U.S. PATENT DOCUMENTS

| | | | | |
|---|---|---|---|---|
| 4,610,295 | A | 9/1986 | Jacoby et al. | |
| 4,628,985 | A | 12/1986 | Jacoby et al. | |
| 4,640,497 | A | 2/1987 | Heamon | |
| 4,651,804 | A | 3/1987 | Grimes et al. | |
| 4,709,740 | A | 12/1987 | Jacoby et al. | |
| 4,709,747 | A | 12/1987 | Yu et al. | |
| 4,724,887 | A | 2/1988 | Jacoby et al. | |
| 4,761,266 | A | 8/1988 | Bruski | |
| 4,769,158 | A | 9/1988 | Eckert | |
| 4,770,697 | A | 9/1988 | Zurecki | |
| 4,773,470 | A | 9/1988 | Libby et al. | |
| 4,781,239 | A | 11/1988 | Cans et al. | |
| 4,858,674 | A | 8/1989 | Enright | |
| 4,930,566 | A | 6/1990 | Yanagimoto et al. | |
| 4,947,925 | A | 8/1990 | Wagstaff et al. | |
| 4,964,993 | A | 10/1990 | Stankiewicz | |
| 4,986,337 | A | 1/1991 | Soulier | |
| 5,028,570 | A | 7/1991 | Winkelbauer et al. | |
| 5,032,171 | A | 7/1991 | Robare et al. | |
| 5,052,469 | A | 10/1991 | Yanagimoto et al. | |
| 5,091,149 | A | 2/1992 | Shin et al. | |
| 5,167,918 | A | 12/1992 | Shin et al. | |
| 5,176,197 | A | 1/1993 | Hamaguchi et al. | |
| 5,185,297 | A | 2/1993 | Park et al. | |
| 5,212,343 | A | 5/1993 | Brupbacher et al. | |
| 5,320,803 | A | 6/1994 | Webster | |
| 5,369,063 | A | 11/1994 | Gee | |
| 5,404,813 | A | 4/1995 | Wong | |
| 5,415,220 | A | 5/1995 | Edwards | |
| 5,427,602 | A | 6/1995 | DeYoung et al. | |
| 5,441,919 | A | 8/1995 | Park et al. | |
| 5,845,481 | A | 12/1998 | Briesch et al. | |
| 5,846,481 | A | 12/1998 | Tilak | |
| 5,873,405 | A | 2/1999 | Carrier et al. | |
| 6,069,910 | A | 5/2000 | Eckert | |
| 6,279,645 | B1 * | 8/2001 | McGlade et al. | 164/151.5 |
| 6,393,044 | B1 | 5/2002 | Fishman et al. | |
| 6,398,844 | B1 | 6/2002 | Hobbs et al. | |
| 6,491,087 | B1 | 12/2002 | Tilak | |
| 6,551,424 | B1 | 4/2003 | Haszler et al. | |
| 6,675,870 | B2 | 1/2004 | Tilak | |
| 6,808,009 | B2 | 10/2004 | Anderson | |
| 6,837,300 | B2 | 1/2005 | Cooper et al. | |
| 7,000,676 | B2 | 2/2006 | Chu et al. | |
| 7,204,295 | B2 | 4/2007 | Schneider et al. | |
| 7,296,613 | B2 | 11/2007 | Anderson et al. | |
| 7,550,028 | B2 | 6/2009 | Riquet et al. | |
| 8,056,611 | B2 | 11/2011 | Gildemeister et al. | |
| 2007/0074846 | A1 * | 4/2007 | Sommerhofer et al. | 164/486 |
| 2009/0269239 | A1 | 10/2009 | Nagakura et al. | |
| 2011/0209843 | A2 | 9/2011 | Bes et al. | |
| 2011/0247456 | A1 | 10/2011 | Rundquist et al. | |

FOREIGN PATENT DOCUMENTS

| | | |
|---|---|---|
| CN | 101967588 | 2/2011 |
| CN | 201892583 | 7/2011 |
| EP | 0090583 | 10/1983 |
| EP | 0109170 | 5/1984 |
| EP | 0142341 | 5/1985 |
| EP | 0150922 | 8/1985 |
| EP | 0183563 | 6/1986 |
| EP | 0229211 | 7/1987 |
| EP | 0229218 | 7/1987 |
| EP | 0281238 | 9/1988 |
| EP | 0295008 | 12/1988 |
| EP | 0364097 | 4/1990 |
| EP | 0726114 | 8/1996 |
| JP | 8268745 | 10/1996 |
| RU | 2048568 | 11/1995 |
| RU | 2261933 | 10/2005 |
| WO | WO-8702069 | 4/1987 |
| WO | WO-2010094852 | 8/2010 |

OTHER PUBLICATIONS

Nair, C. G., et al., "Technology for Aluminium-Lithium Alloy Production—Ingot Casting Route", Science and Technology of Aluminium-Lithium Alloys, Bangalore, India, (Mar. 4-5, 1989), Abstract.

Ohara, K., et al., "Hot-tearing of Al-Li alloys in DC casting", 4th International Conference on Aluminum Alloys: Their Physical and Mechanical Properties, vol. II, (Sep. 11-16, 1994), Abstract.

Page, F. M., et al., "The Safety of Molten Aluminium-Lithium Alloys in the Presence of Coolants", Journal de Physique 48, Supplement No. 9, (Sep. 1987), C3-63-C3-73.

* cited by examiner

APPARATUS FOR CASTING ALUMINUM LITHIUM ALLOYS

FIELD

Direct chill casting of aluminum lithium alloys.

BACKGROUND

Traditional (non-lithium containing) aluminum alloys have been semi-continuously cast in open bottom molds since the invention of Direct Chill casting in the 1938 by the Aluminum Company of America (now Alcoa). Many modifications and alterations to the process have occurred over the years since then, but the basic process remains essentially the same. Those skilled in the art of aluminum ingot casting will understand that new innovations improve the process, while maintaining its general functions. From the beginning of the use of this process, water has been used as the coolant of preference to chill the open-bottomed mold which provides the primary cooling in forming the solid ingot shell and also to be used to provide the secondary cooling of the ingot shell below the bottom of the mold.

Unfortunately, there is an inherent risk from a "bleed-out" or "run-out" during the casting process. Due to the inherent nature of the process the perimeter of the ingot comprises a thin shell of solidified metal holding an inner cavity of partially solidified and liquid molten metal that will bleed-thru the ingot shell if there is an occurrence where the aluminum ingot being cast is not properly solidified. Molten aluminum can then come into contact with the water coolant in various locations in the casting pit (e.g. between the ingot butt or bottom and the starting block, on the metal (usually steel) bottom block base, the pit walls or at the bottom of the pit) as well as in the ingot cavity where the water can enter through a rupture in the ingot shell below the bottom of the mold. Water during a "bleed-out" or "run-out" can cause an explosion from (1) conversion of water to steam from the thermal mass of the aluminum heating the water to >212° F. or (2) the chemical reaction of the molten metal with the water resulting in release of energy causing a chemical reaction generated explosion.

U.S. Pat. No. 4,651,804 describes a more modern aluminum casting pit design. According to this reference, it has become standard practice to mount the metal melting furnace slightly above ground level with the casting mould at, or near to, ground level and lower the cast ingot into a water containing pit as the casting operation proceeds. Cooling water from the direct chill flows into the pit and is continuously removed there-from while leaving a permanent deep pool of water within the pit. This process remains in current use and, throughout the world, probably in excess of 5 million tons of aluminum and its alloys are produced annually by this method. However, the use of this permanent deep pool of water does not prevent all explosions from occurring in a casting pit, since explosions can still occur in other locations in the casting pit such as mentioned above where there is still water coming into contact with molten aluminum. In spite of these improvements, there are still a significant number of explosions during the casting process each year even with use of deep pool water pits.

With the advent of aluminum lithium alloys the danger of explosions has increased further, because some of the preventive measures typically used for minimizing the potential for molten aluminum and water explosions are no longer sufficient. Again referencing U.S. Pat. No. 4,651,804, in the last several years, there has been growing interest in light metal alloys containing lithium. Lithium makes the molten alloys more reactive. In a "Metal Progress" article, May 1957, pages 107 to 112, (hereinafter referred to as "Long"), Long refers to previous work by H. M. Higgins who had reported on aluminum/water reactions for a number of alloys including Al—Li and concluded that "When the molten metals were dispersed in water in any way . . . Al—Li alloy . . . underwent a violent reaction." It has also been announced by the Aluminum Association Inc. (of America) that there are particular hazards when casting such alloys by the direct chill process. The Aluminum Company of America has subsequently published video recordings of tests that demonstrate that such alloys can explode with great violence when mixed with water.

Other work has demonstrated that the explosive forces associated with adding lithium to aluminum alloys can increase the nature of the explosive energy several times that for aluminum alloys without lithium. When molten aluminum alloys containing lithium come into contact with water, there is the rapid evolution of hydrogen, as the water dissociates to Li—OH+$H^+$. U.S. Pat. No. 5,212,343 teaches the addition of aluminum, lithium (and other elements as well) to water to initiate an explosive reaction. The exothermic reaction of these elements (particularly aluminum and lithium) in water produces large amounts of hydrogen gas, typically 14 cubic centimeters of hydrogen gas is generated per one gram of molten aluminum lithium alloy exposed to water (Ref: U.S. Department of Energy funded research under contract number #DE-AC09-89SR18035). The first claim of U.S. Pat. No. 5,212,343 describes the method to perform this intense interaction for producing a water explosion via the exothermic reaction. This patent describes that with the addition of elements such as lithium a high energy of reaction per unit volume of materials is achieved. As described in U.S. Pat. Nos. 5,212,343 and 5,404,813, the addition of lithium (or some other chemically active element) promotes explosions. These patents teach a process where an explosive reaction is a desirable outcome. These patents reinforce the explosiveness of the addition of lithium to the "bleed-out" or "run-out", as compared to aluminum alloys without lithium.

The purpose of the modified casting pit design as described in U.S. Pat. No. 4,651,804 is to minimize the potential of an explosion at the bottom of the casting pit when a "bleed-out" or "run-out" occurs during casting of Al—Li alloys. This technique continues to use the coolant water to cool the molds and cool the ingot shell, even after a bleed-out. If the coolant is turned off there is a potential for more serious problems with a melt-through of the molds or additional melt-throughs of the ingot shell causing additional potential for explosions when molten aluminum-lithium and water come into contact. Leaving the water coolant running after a "bleed-out" or "run-out" has occurred has two distinct disadvantages: 1) potential for a molten metal water explosion at various locations near the top of the casting pit or in the ingot crater; 2) potential for a hydrogen explosion because of the generation of H2 as discussed above.

In another method to conducting direct chill casting, patents have been issued related to casting Al—LI alloys using an ingot coolant other than water to provide ingot cooling without the water-lithium reaction from a "bleed-out" or "run-out". U.S. Pat. No. 4,593,745 describes using a halogenated hydrocarbon or halogenated alcohol. U.S. Pat. Nos. 4,610,295; 4,709,740 and 4,724,887 describe the use of ethylene glycol as the ingot coolant. For this to work, the halogenated hydrocarbon (typically ethylene glycol) must be free of water and water vapor. This is a solution to the explosion hazard, but also introduces a strong fire hazard and is costly to implement and maintain. A fire suppression system is required within the casting pit to contain potential glycol fires. A typical cost to implement a glycol based ingot coolant system including a glycol handling system, a thermal oxidizer to de-hydrate the glycol, and a casting pit fire protection system is on the order of $5 to $8 million dollars (in today's dollars). Casting with 100% glycol as a coolant also brings in another issue. The cooling capability of glycol or other halogenated hydrocarbons is different than that for water, and different casting practices as well as casting tooling are required to utilize this technology. Another disadvantage affiliated with using glycol as a straight coolant is that because glycol has a lower heat conductivity and surface heat transfer coefficient than water, the microstructure of the metal cast with 100% glycol as a coolant tends to have coarser undesirable metallurgical constituents and exhibits higher amount of centerline shrinkage porosity in the cast product. Absence of finer microstructure and simultaneous presence of higher concentration of shrinkage porosity has a deleterious effect on the properties of the end products manufactured from such initial stock.

In yet another case, described in U.S. Pat. No. 4,237,961, the water is removed from the ingot during direct chill casting. In European Patent No. 0-183-563, a device is described for collecting the "break-out" or "run-out" molten metal during direct chill casting of aluminum alloys. Collecting the "break-out" or "run-out" molten metal concentrates this mass of molten metal. This teaching cannot be used for Al—Li casting since it would create an artificial explosion condition where removal of the water would result in a pooling of the water as it is being collected for removal. During a "bleed-out" or "run-out" of the molten metal, the "bleed-out" material would also be concentrated in the pooled water area. As taught in U.S. Pat. No. 5,212,343, this would be a preferred way to create a reactive water/Al—Li explosion.

Accordingly, there remains a significant need for improved apparatus and processes to further minimize the potential for explosions in the direct chill casting of Al—Li alloys and to simultaneously produce a higher quality of the cast product.

DETAILED DESCRIPTION

Figure 1:
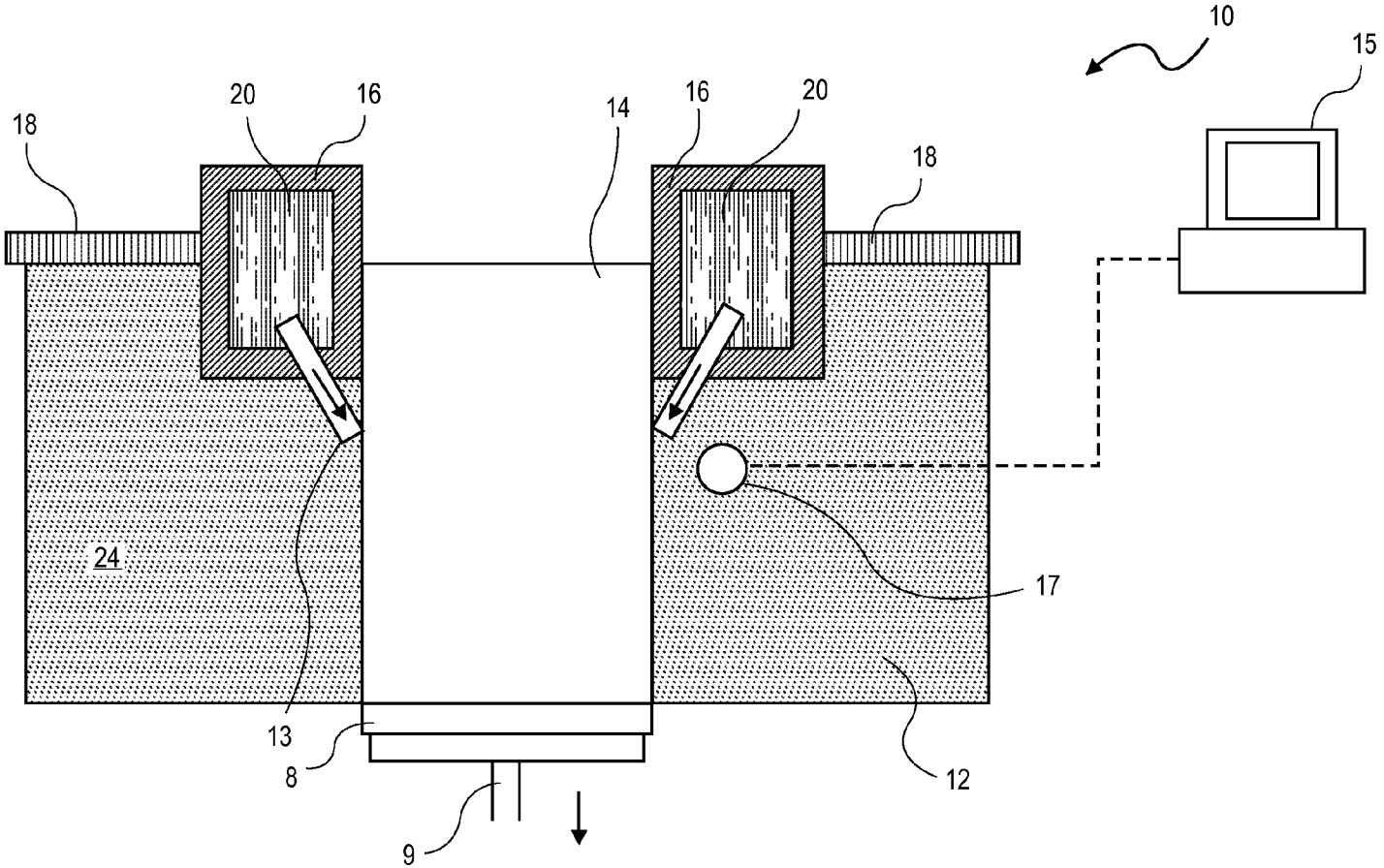
FIG. 1 is a cut-away view of one section of a direct chill casting system.

Referring now to the accompanying drawings, FIG. 1 shows components of a direct chill (DC) casting system. System 10 includes casting pit 12 into which cast ingot 14 is lowered by a casting cylinder (not shown) during a casting operation. Mold 16 is seated on casting table 18. Molten metal (e.g., Al—Li alloy) is fed into mold 16. The molten metal that is fed into mold 16 is supported by platen 8 on casting cylinder 9. Mold 16 is cooled by coolant contained in reservoir 20 within mold 16 and shapes ingot 14 as molten metal is fed from above at a predetermined, time varying rate. Casting cylinder 9 is displaced at a predetermined rate in a downward direction in this view to produce an ingot having a desired length dimension and a desired geometrical shape as defined by the perimeter of casting mold 16.

The molten metal added to mold 16 is cooled in mold 16 by the cooler temperature of the casting mold and through introduction of a coolant that impinges on ingot 14 after it emerges from the mold cavity through a plurality of conduit feeds 13 (two shown) around mold 16 at its base. It is appreciated that there may be a number of conduit feeds configured to deliver coolant (e.g., water) from reservoir 20 into casting pit 12, including feeds positioned around the base of mold 16 in an amount and position to achieve a desired solidification rate of a molten metal. The coolant feeds about a periphery of ingot 14 corresponding to a point just below where coolant exits conduit feeds 13. The latter location is commonly referred to as a solidification zone. Where the coolant is water, mixture 24 of water and air is produced in casting pit 10 about the periphery of ingot 14, and into which freshly produced water vapor gets continuously introduced as the casting operation continues.

The embodiment of a casting system shown in FIG. 1 also includes "bleed out" detection device 17 such as an infrared thermometer. "Bleed out" detection device 17 may be directly and/or logically connected to controller 15 associated with the system. In one embodiment, each of a movement of platen 8/casting cylinder 9, a molten metal supply inlet to mold 16 and a water inlet to reservoir 20 associated with mold 16 are controlled by controller 15. Controller 15 contains machine-readable program instructions as a form of non-transitory tangible media. In one embodiment, when an Al—Li molten metal "bleed out" or "run out" is detected by "bleed out" detection device 17, a signal is sent from "bleed out" detection device 17 to controller 15. The machine readable instructions stored in controller 15 cause movement of platen 8 and molten metal inlet supply (not shown) to stop, and coolant flow (not shown) into reservoir 20 associated with mold 16 to stop and/or be diverted.

Figure 2:
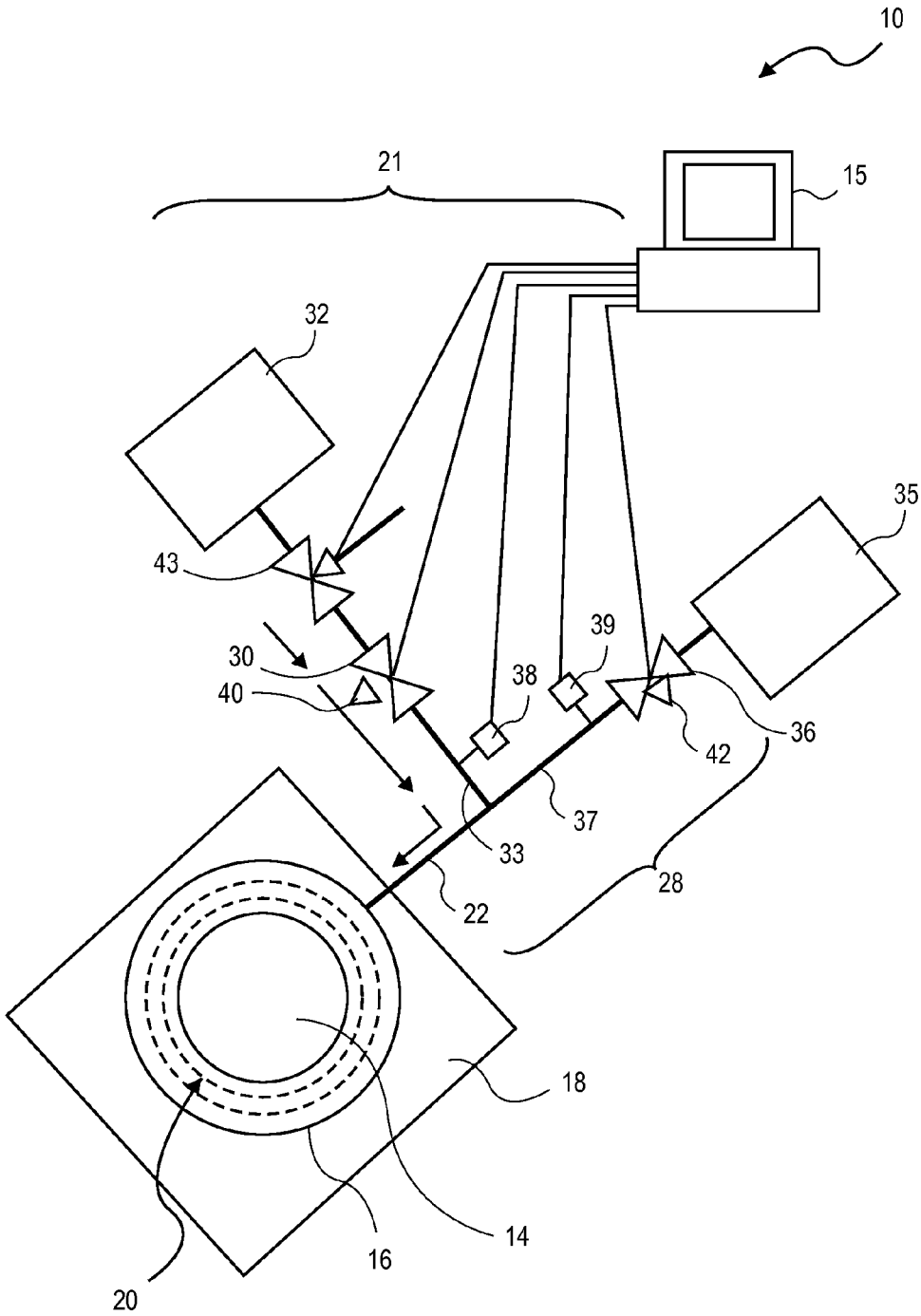
FIG. 2 is a top view schematic representation of a portion of the system of FIG. 1 illustrating a configuration for injecting simultaneously with a coolant or serially therewith inert fluid to a direct chill casting mold or a coolant feed to cool the ingot during normal casting operations.

Shown in FIG. 2, is a schematic top plan view of system 10. In this embodiment, system 10 includes coolant feed system 21 that is placed in the coolant feed, either between reservoir 20 and conduit feed 22 or upstream of reservoir 20. As shown in FIG. 2, coolant feed system 21 is upstream of reservoir 20. Mold 16 (illustrated in this embodiment as a round mold) surrounds metal 14. Also as seen in FIG. 2, coolant feed system 21 includes valve system 28 connected to conduit feed 22 that feeds reservoir 20. Suitable material for conduit feed 22 and the other conduits and valves discussed herein includes, but is not limited to, stainless steel (e.g., a stainless steel tubular conduit). Valve system 28 includes first valve 30 associated with first conduit 33. First valve 30 allows for the introduction of a coolant (generally water) from coolant source 32 through valve 30 and conduit 33. Valve system 28 also includes second valve 36 associated with second conduit 37. In one embodiment, second valve 36 allows for the introduction of an inert fluid from inert fluid source 35 through the valve and conduit 37. Conduit systems 33 and 37 connect coolant source 32 and inert fluid source 35, respectively, to conduit feed 22. An inert fluid is a liquid or gas that will not react with lithium or aluminum to produce a reactive (e.g., explosive) product and at the same time will not be combustible or support combustion. In one embodiment, an inert fluid is an inert gas. A suitable inert gas is a gas that has a density that is less than a density of air and will not react with lithium or aluminum to produce a reactive product. Another required property of a suitable inert gas to be used in the subject embodiment is that the gas should have a higher thermal conductivity than ordinarily available in inert gases or in air and inert gas mixtures. An example of such suitable gas simultaneously meeting all of the aforesaid requirements is helium (He). In an alternative preferred embodiment mixtures of helium and argon may be used. According to one embodiment, such a mixture includes at least about 20 percent helium. According to another embodiment, such a mixture includes at least about 60 percent helium.

It is to be noted that those skilled in the art of melting and direct chill casting of aluminum alloys except the melting and casting of aluminum-lithium alloys may be tempted to use nitrogen gas in place of helium because of the general industrial knowledge that nitrogen is also an 'inert' gas and is lighter than air. However, for the reason of maintaining process safety, it is mentioned herein it is believed that nitrogen is really not an inert gas when it comes to interacting with liquid aluminum-lithium alloys. Nitrogen reacts with the molten aluminum-lithium alloy and produces ammonia which in turns reacts with water and brings in additional reactions of dangerous consequences, and hence the use of nitrogen should be completely avoided. It is also believed the same holds true for another presumably inert gas, carbon dioxide. Its use should be avoided in any application where there is a finite chance of molten aluminum lithium alloy to get in contact with carbon dioxide.

In FIG. 2, which represents normal casting conditions, first valve 30 is open and second valve 36 is closed. In this valve configuration, only coolant from coolant source 32 is admitted into conduit feed 22 while inert fluid from inert fluid source 35 is excluded therefrom. A position (e.g., fully opened, partially opened) of valve 30 may be selected to achieve a desired flow rate, measured by a flow rate monitor associated with valve 30 or separately positioned adjacent valve 30 (illustrated downstream of valve 30 as first flow rate monitor 38). According to one embodiment, where desired, second valve 36, can be partially opened so that inert fluid (e.g., an inert gas) from inert fluid source 35 may be mixed with coolant from coolant source 32 during normal casting conditions. A position of valve 36 may be selected to achieve a desired flow rate, measured by a flow rate monitor associated with valve 36 or separately positioned adjacent valve 36 (illustrated downstream of valve 36 as second flow rate monitor 39) (e.g., a pressure monitor for an inert fluid source).

In one embodiment, each of first valve 30, second valve 36, first flow rate monitor 38 and second flow rate monitor 39 is electrically and/or logically connected to controller 15. Controller 15 includes non-transitory machine-readable instructions that, when executed, cause one or both of first valve 30 and second valve 36 to be actuated. For example, under normal casting operations such as shown in FIG. 2, such machine-readable instructions cause first valve 30 to be open partially or fully and second valve 36 to be closed or partially open.

Figure 3:
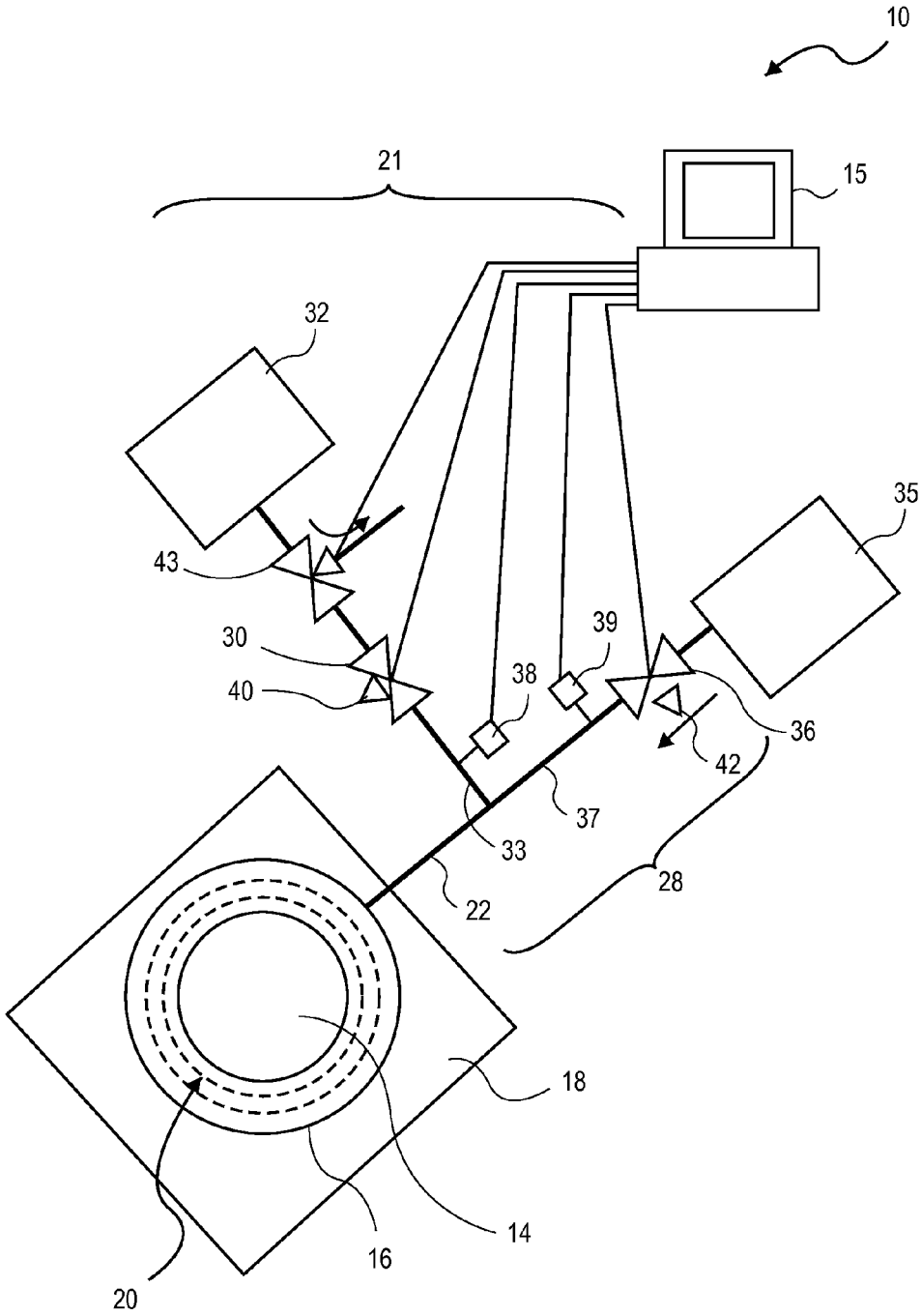
FIG. 3 is a top view schematic representation of a portion of the system of FIG. 1 following the stopping of the flow of liquid coolant (water) and injecting only inert fluid as the coolant during or following a "bleed out" or "run out".

Turning now to FIG. 3, this figure shows valve system 28 in a configuration upon an occurrence of a "bleed out" or "run "out". Under these circumstances, upon detection of a "bleed out" or "run out" by bleed out detection device 17 (see FIG. 1), first valve 30 is closed to stop the flow of coolant (e.g., water) from coolant source 32. At the same time or shortly thereafter, within 3 to 20 seconds, second valve 36 is opened to allow the admission of an inert fluid from inert fluid source 35, so that the only inert fluid is admitted into conduit feed 22. Where an inert fluid is an inert gas such as helium (He), under this condition, given the lower density of helium than air, water or water vapor, the area at the top of casting pit 10 and about mold 16 (see FIG. 1) is immediately flooded with inert gas thereby displacing mixture 24 of water and air and inhibiting the formation of hydrogen gas or contact of molten Al/Li alloy with coolant (e.g., water) in this area, thereby significantly reducing the possibility of an explosion due to the presence of these materials in this region. Velocities of between 1.0 ft/sec and about 6.5 ft/sec., preferably between about 1.5 ft/sec and about 3 ft/sec and most preferably about 2.5 ft/sec are used.

Also shown in FIGS. 2 and 3 are check valve 40 and check valve 42 associated with first valve 30 and second valve 36, respectively. Each check valve inhibits the flow of coolant and or gas backward into respective valves 30 and 36 upon the detection of a bleed out and a change in material flow into mold.

As shown schematically in FIGS. 2 and 3, in one embodiment, coolant supply line 32 is preferably also equipped with by-pass valve 43 to allow for immediate diversion of the flow of coolant to an external "dump" prior to its entry into first valve 30, so that upon closure of first valve 30, water hammering or damage to the feed system or leakage through valve 30 is minimized. In one embodiment, the machine-readable instructions in controller 15 include instructions such that once a "bleed out" is detected by, for example, a signal to controller 15 from an infrared thermometer, the instructions cause by-pass valve 43 to be actuated to open to divert coolant flow; first valve 30 to be actuated sequentially to closed; second valve 36 actuated to open to allow admission of an inert gas.

As noted above, one suitable inert gas is helium. Helium has a relatively high heat conductivity that allows for continuous extraction of heat from a casting mold and from solidification zone once coolant flow is halted. This continuous heat extraction serves to cool the ingot/billet being cast thereby reducing the possibility of any additional "bleed outs" or "run outs" occurring due to residual heat in the head of the ingot/billet. Simultaneously the mold is protected from excessive heating thereby reducing the potential for damage to the mold. As a comparison, thermal conductivities for helium, water and glycol are as follows: He; 0.1513 $W \cdot m^{-1} \cdot K^{-1}$; H2O; 0.609 $W \cdot m^{-1} \cdot K^{-1}$; and Ethylene Glycol; 0.258 $W \cdot m^{-1} \cdot K^{-1}$.

Although the thermal conductivity of helium, and the gas mixtures described above, are lower than those of water or glycol, when these gases impinge upon an ingot or billet at or near a solidification zone, no "steam curtain" is produced that might otherwise reduce the surface heat transfer coefficient and thereby the effective thermal conductivity of the coolant. Thus, a single inert gas or a gas mixture exhibits an effective thermal conductivity much closer to that of water or glycol than might first be anticipated considering only their directly relative thermal conductivities.

As will be apparent to the skilled artisan, while FIGS. 2 and 3 depict a billet or round section of cast metal being formed, the apparatus and method of the present invention is equally applicable to the casting of rectangular ingot.

There has thus been described a system and apparatus for minimizing the likelihood of an explosion in the direct chill casting of Al/Li alloys that provides for the selective stoppage of liquid coolant with the simultaneous introduction of an inert fluid, such as an inert gas having high heat conductivity and low specific gravity into the solidification zone. According to an alternative preferred embodiment, a mixture of inert fluid and coolant can be fed to the solidification zone or a mixture of inert gases can be fed to the solidification zone.

In the description above, for the purposes of explanation, numerous specific requirements and several specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated among the figures to indicate corresponding or analogous elements, which may optionally have similar characteristics.

It should also be appreciated that reference throughout this specification to "one embodiment", "an embodiment", "one or more embodiments", or "different embodiments", for example, means that a particular feature may be included in the practice of the invention. Similarly, it should be appreciated that in the description various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

What is claimed is:

1. An apparatus for direct chill casting of aluminum lithium alloys comprising a casting pit having a mold table supporting a mold, a coolant feed associated with the mold that allows coolant to impinge upon a solidification zone of an ingot being cast, the apparatus comprising a valve system comprising at least a first valve and a second valve, the first valve allowing for admission of a coolant into the coolant feed and the second valve allowing for admission of an inert gas into the coolant feed, wherein the valve system is located in the coolant feed such that coolant, a mix of coolant and inert gas or just inert gas can be selectively fed to the solidification zone of the ingot being cast.

2. The apparatus of claim 1, wherein the mold comprises a reservoir and the valve system is located upstream of the reservoir.

3. The apparatus of claim 1, further comprising an inert gas source coupled to the second valve, wherein the inert gas source comprises helium.

4. The apparatus of claim 1, further comprising an inert gas source coupled to the second valve, wherein the inert gas is a mixture of helium and argon.

5. The apparatus of claim 1, further comprising an inert gas source coupled to the second valve, wherein the inert gas is a mixture of helium and argon comprising at least about 20 percent helium.

6. The apparatus of claim 1, further comprising an inert gas source coupled to the second valve, wherein the inert gas is a mixture of helium and argon comprising at least about 60 percent helium.

7. The apparatus of claim 1, further comprising a controller and the first valve and the second valve are electrically coupled to the controller, the controller comprising non-transitory machine-readable instructions that when executed by the controller actuate one of the first valve and the second valve to open and the other of the first valve and the second valve to closed or, when the other of the first valve and the second valve is the second valve to partially closed.

8. The apparatus of claim 1, further comprising a bleed out detection device and a controller wherein the first valve, the second valve and the bleed out device are electrically coupled to the controller, wherein the controller comprises non-transitory machine-readable instructions that when executed by the controller, actuates the first valve to closed to stop the flow of coolant upon detection of bleed out and actuated the second valve to open to introduce a flow of inert gas into the coolant feed reservoir.

9. The apparatus of claim 8, wherein the inert gas is helium.

10. The apparatus of claim 8, wherein the inert gas is a mixture of helium and argon.

11. The apparatus of claim 8, wherein the inert gas is a mixture of helium and argon comprising at least about 20 percent helium.

12. The apparatus of claim 8, wherein the inert gas is a mixture of helium and argon comprising at least about 60 percent helium.

13. A method for minimizing a potential for an explosion in the direct chill casting of aluminum lithium alloys comprising using an apparatus comprising a casting pit having a mold table supporting a mold, a coolant reservoir in the mold and a coolant feed fed by the reservoir which allows coolant to impinge upon a solidification zone of an ingot being cast, further including a valve system comprising at least a first and a second valve, the first valve allowing for the selective admission of coolant into the coolant feed and the second valve allowing for the selective admission of an inert gas into the coolant feed.

14. The method of claim 13, wherein the apparatus includes a bleed out detection mechanism and when a bleed out is detected, the method closing the first valve to cut off the supply of coolant to the solidification zone and opening the second valve to allow for the injection of inert gas into the solidification zone.

15. The method of claim 14, wherein the inert gas is helium.

16. The method of claim 14, wherein the inert gas is a mixture of helium and argon.

17. The method of claim 14, wherein the inert gas is a mixture of helium and argon comprising at least about 20 percent helium.

18. The method of claim 14, wherein the inert gas is a mixture of helium and argon comprising at least about 60 percent helium.

* * * * *

UNITED STATES PATENT AND TRADEMARK OFFICE

CERTIFICATE OF CORRECTION

PATENT NO. : 8,479,802 B1
APPLICATION NO. : 13/474616
DATED : July 9, 2013
INVENTOR(S) : Ravindra V. Tilak, Rodney W. Wirtz and Ronald M. Streigle It is certified that error appears in the above-identified patent and that said Letters Patent is hereby corrected as shown below:

On the Title Page, in Item [73] under Assignee, please delete "Bueno" and insert --Buena--.

Signed and Sealed this
Twentieth Day of August, 2013

Teresa Stanek Rea
*Acting Director of the United States Patent and Trademark Office*